US008915211B2

(12) United States Patent
Salazar et al.

(10) Patent No.: US 8,915,211 B2
(45) Date of Patent: Dec. 23, 2014

(54) APPARATUS FOR RESIN IMPREGNATION

(76) Inventors: Ramon Salazar, South El Monte, CA (US); Eduardo Dera, Winnetka, CA (US)

( * ) Notice: Subject to any disclaimer, the term of this patent is extended or adjusted under 35 U.S.C. 154(b) by 995 days.

(21) Appl. No.: 12/754,470

(22) Filed: Apr. 5, 2010

(65) Prior Publication Data

US 2011/0239935 A1 Oct. 6, 2011

(51) Int. Cl.

| | |
|---|---|
| ***B05C 3/12*** | (2006.01) |
| ***B05D 5/10*** | (2006.01) |
| ***B05C 1/08*** | (2006.01) |

(52) U.S. Cl.

CPC ..... *B05C 3/125* (2013.01); *B05C 1/0865* (2013.01); *B05C 1/0869* (2013.01)

USPC ..... 118/420; 427/208

(58) Field of Classification Search

USPC ..... 427/208, 211; 118/316

See application file for complete search history.

(56) References Cited

U.S. PATENT DOCUMENTS

| | | | | | |
|---|---|---|---|---|---|
| 1,558,271 | A | * | 10/1925 | Newell | 427/365 |
| 2,771,387 | A | * | 11/1956 | Kleist et al. | 442/367 |
| 3,350,027 | A | * | 10/1967 | Egan | 242/527 |
| 4,177,754 | A | * | 12/1979 | James et al. | 118/47 |
| 4,561,377 | A | | 12/1985 | Youngkeit | |
| 5,476,567 | A | * | 12/1995 | Fujisawa et al. | 156/281 |
| 5,607,531 | A | * | 3/1997 | Needham et al. | 156/166 |
| 2006/0177591 | A1 | | 8/2006 | Raday | |
| 2007/0000947 | A1 | * | 1/2007 | Lewis et al. | 222/132 |
| 2009/0065130 | A1 | | 3/2009 | Fram | |

* cited by examiner

*Primary Examiner* — Dah-Wei D Yuan

*Assistant Examiner* — Charles Capozzi

(74) *Attorney, Agent, or Firm* — Khoo Patent Services; Denis Khoo

(57) ABSTRACT

A two roller impregnator for impregnating a fiber with (catalyzed) resin. The resin is kept directly above the two rollers and enclosed with a set of dams to create a resin pool. A different resin pool may be generated for each roller. The resin release mechanism facilitates for the resin and if necessary, a catalyst, to be released into the resin pool(s). Temperature of the resin pool can be controlled, along with the temperature of each roller. A post-impregnation catalyst activator can be utilized to activate the catalyst.

11 Claims, 4 Drawing Sheets

APPARATUS FOR RESIN IMPREGNATION

BACKGROUND OF THE INVENTION

1. Field of the Invention

This invention generally relates to an apparatus for resin impregnation and, more specifically, to an apparatus for controlling resin impregnation of a fiber.

2. Description of Related Art

Traditionally, fibers are impregnated by passing them manually through a resin bath, using an applicator roller, or injection die. These methods require a high burden of manual handling, and typically do not result in non-uniform impregnation, and may result in the entrapment of air within the resin. This leads to a weakening of the part. Such methods and other can be found in U.S. Pat. Nos. 5,766,357, 6,387,179, and 6,179,945.

U.S. Pat. No. 7,413,623 describes many of the methods for resin impregnation of the prior art. U.S. Pat. No. 7,413,623 is incorporated herein by reference. U.S. Pat. No. 7,413,623 improves upon the prior art by employing the use of two roll impregnators, wherein the fiber passes through a resin pool directly above the two rollers. The resin pool resides sits above the two impregnation rollers and is held in from the sides by a set of dams. When the fiber passes through the two rollers, full impregnation is fostered, excess resin removed, and the impregnated fiber degassed. At least one of the two impregnator rollers can be adjusted to be closer or further from the other impregnator roller, allowing for control of the tension applied on the fiber. Outside of the two impregnation rollers is a set of alignment/tensioning bars.

U.S. patent application Ser. No. 12/208,322, published on Mar. 12, 2009, describes a system and method for using at least one roller to impregnate fibers with a liquid resin within a pressurized zone. The use of two rollers for impregnation with a pressurized zone at the output side of the rollers is also described.

None of the existing techniques for impregnation using impregnation rollers describe a convenient means for automatically adding resin to the resin pool. In addition, the existing techniques do not employ the use of temperature control for the resin pool or rollers, and the use of a latent catalyst system, which is automatically activated after the impregnation.

BRIEF SUMMARY OF THE INVENTION

The present invention provides a novel apparatus for resin impregnation and wet-out of a fiber. The apparatus employs two impregnator rollers (nip rollers) for impregnating the resin into the fiber. A resin pool sits above the two impregnator rollers, and is held in on the sides by a set of dams. In one embodiment, two different resin pools exist, one for each side of the fiber. The resin pool may be filled automatically through a resin release mechanism. The resin may be mixed with a catalyst prior to being added to the resin pool to form a catalyzed resin. The resin is fanned into the resin pool(s).

In another embodiment, the impregnating rollers may have internal heating or cooling to control the temperature. Temperature may need controlled in order to maintain the proper viscosity of the resin.

If a latent catalyst system is utilized, the catalyst may be activated by heat or light. This is performed through the post-impregnation catalyst activator, placed below the impregnated rollers to automatically activate the catalyst after impregnation.

DETAILED DESCRIPTION OF A PREFERRED EMBODIMENT(S)

While this invention can take various forms, it generally provides a novel apparatus for impregnating resin onto a fiber, sometimes known as wet-out. The apparatus of this invention generally uses a two roller system to perform the impregnation. The novel features of the apparatus make this two roller impregnation system's usability and performance superior to previous ones. Usability and performance are enhanced through a set of features, as will be described in various embodiments of the invention below. The various embodiments describe a novel roller impregnator system comprised of gears, dual pooling of resin, a resin release mechanism, temperature control of the rollers, and a post-impregnation catalyst activation system.

Figure 1:
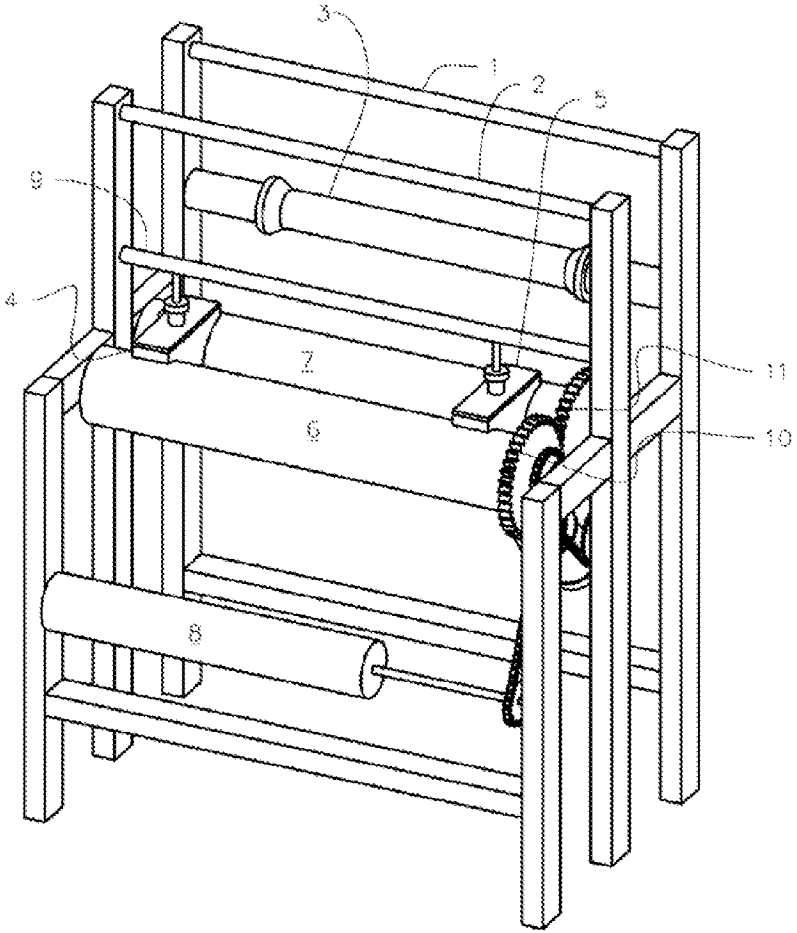
FIG. 1 is a front perspective view of a preferred embodiment of the current invention.

FIG. 1 is a diagram of an embodiment of the present invention. The apparatus of FIG. 1 is held together by a frame, which has a right side, left side, and a number of crossbars connecting the right and left sides. The frame may have wheel attachments at the bottom of the legs, which allow for easy mobility of the apparatus. At the top of the frame, there are two guide bars 1, 2. These guide bars 1, 2 help guide the fabric, which begins at the fabric roll dispensing bar 3. The fabric roll dispensing bar 3 acts as a shaft for holding a roll of fabric. From the fabric roll dispensing bar 3, the fabric goes above the two guide bars 1, 2. The fabric roll dispensing bar 3 itself may be rotatable, but does not have to if it holds a fabric roll which has a hollow center with a diameter larger than the diameter of the fabric roll dispensing bar 3. This fabric roll dispensing bar is ideally removable, to more easily slide in and slide out a roll of fabric. Two removable and adjustable collars are present to hold the fabric roll in place. The guide bars 1, 2 and fabric roll dispensing bar are desirable, but not essential.

Once the fabric is guided above the two guide bars 1, 2, the fabric makes its way between the nip rollers 6, 7. FIG. 1 shows a preferred embodiment of the nip rollers 6, 7 that rotate through the use of a motor, sprockets, and gears.

The front nip roller 6 may be adjusted to be closer or further from the rear nip roller 7, to adjust the nip gap and accommodate different thicknesses of fabric. It is desirable for the nip rollers 6, 7 should be close enough to create enough pressure on the fabric for a few reasons. One such reason is to ensure adequate impregnation of the resin into the fabric. Another such reason is so the fabric will be pulled the nip rollers 6, 7. In a preferred embodiment, the rear nip roller 7 may be adjusted to be closer or further from the front nip roller 6 through an adjustment means.

In a preferred embodiment, the nip rollers 6, 7 are comprised of carbon steel, and are hollow. A large variety of other materials may be used to produce the nip rollers as known to those skilled in the art, and the nip rollers are not required to be hollow. A hollow nip roller may be more easily cooled or heated through various means, including water and steam.

The cooling and/or heating of the nip rollers 6, 7 helps to control the temperature during the impregnation of the resin into the fabric.

Above the two nip rollers 6, 7 is a dam holder bar 9. The dam holder bar 9 has two attachment rods that protrude towards the nip rollers. These attachment rods each hold a dam 4, 5 at the bottom ends of the attachment rods. The dams 4, 5 are held to the attachment rods via a spring loaded mechanism to urge the dams 4, 5 towards the nip rollers 6, 7. The spring action allows for the dams 4, 5 to apply constant pressure between the dams 4, 5 and the nip rollers 6, 7. Also, by being spring loaded, these dams 4, 5 may be more easily removed and adjusted. Alternatives to spring loading include hydraulics or a compactable rubberized backing. However, spring loading or other alternative means are not required. Gravity may be sufficient, as the rotation of the nip rollers 6, 7 provide downward pull on the dams 4, 5. The dams 4, 5 prevent the resin in the resin pool, which sits above the nip rollers 6, 7, from flowing off the sides. Thus, it is important for the dams 4, 5 to provide a tight seal to prevent the resin from escaping. As such, the bottom part of the dams are shaped to be flush with the nip rollers 6, 7. The distance between the two dams 4, 5 may be adjusted to accommodate the width of the fabric. There are numerous other methods known to those skilled in the art for placing dams on the nip rollers.

The fabric is impregnated with the resin as it moves through the nip rollers 6, 7. The fabric is moved through the apparatus by way of friction and rotation between the nip rollers 6, 7. In a preferred embodiment, after the fabric passes the nip rollers 6, 7, it may be rolled around a receiver roller 8. The receiver roller is removable. The receiver roller 8 may rotate by use of the motor, and it is desirable for the receiver roller 8 to rotate at the same rate the fabric is being pushed out of the nip rollers 6, 7 (herein referred to as operational speed). E.g., if the nip rollers 6, 7 are pushing out the fabric at 10 ft per minute (operational speed), it is desirable for the receiver roller 8 to be rotating at a rate to roll up fabric at about 10 ft per minute (operational speed) as well. Rotation of the receiving roller 8 may be achieved by having a roller chain on the sprocket of the front nip roller 6 and sprocket of the receiver roller 8. The receiving roller 8, although useful, it not necessary.

Figure 2:
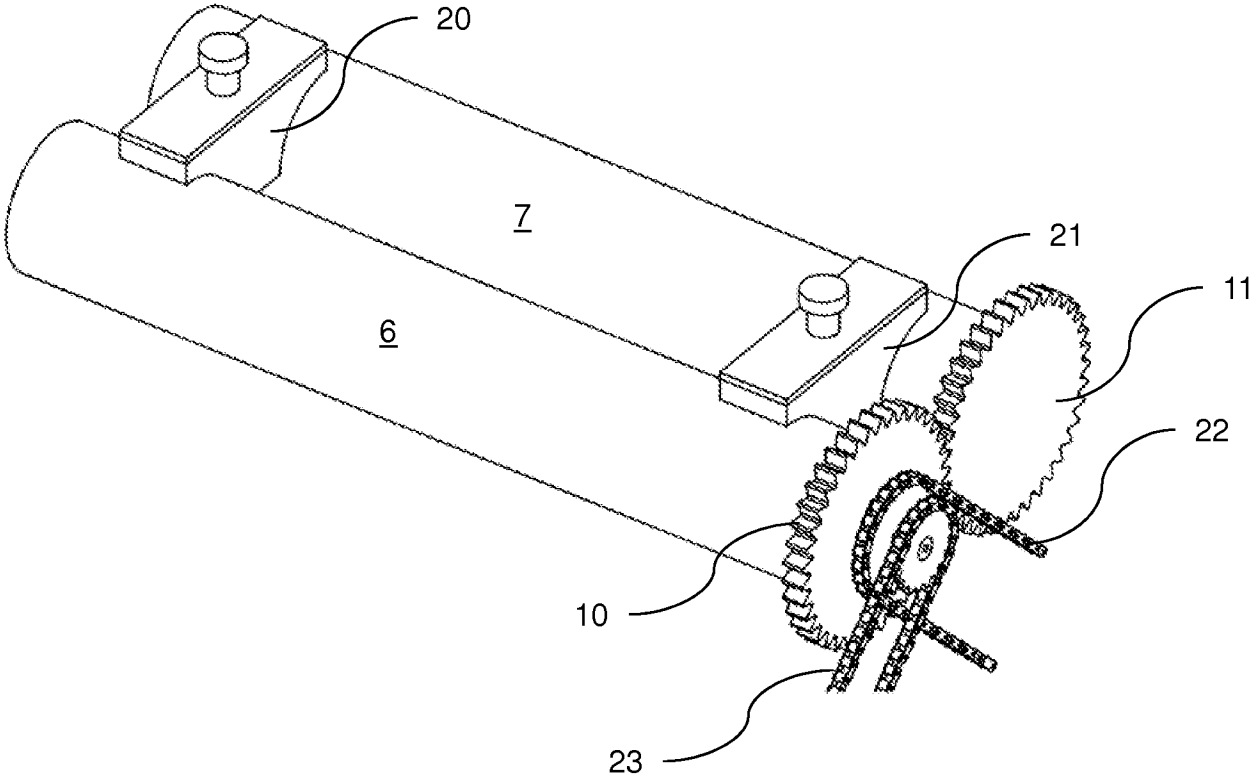
FIG. 2 is an illustration of a preferred embodiment of the nip rollers, where the resin pools reside.

FIG. 2 illustrates a close up of the nip rollers 6, 7 and associated gears 10, 11, sprockets, and chains 22, 23. In a preferred embodiment, the drive system is powered by a motor and motor control box. The drive system may be powered by other means, such as a hand crank or hydraulic. A sprocket from the motor (not displayed) is chained 22 to the sprocket of the front nip roller 6, and its speed may be varied by a motor control box. The motor may be operated via a set of pedals that allow for forward or reverse movements of the motor. The pedals may be designed so that the speed of the motor is dependent on the force applied to the pedals. The pedals may be set to operate the motor only when depressed. This provides an approved safety means. Other approved safety means may include a kill button or kill switch that is easily accessible by the operator.

The front nip roller 6 operates the rear nip roller 7 through gears. The front and rear nip rollers 6, 7 rotate in opposite direction to one another. With same sized gears attached to each nip roller 6, 7, the speed of rotation of both nip rollers 6, 7 are equal. Those skilled in the art understand that there are other possible known methods for rotating the nip rollers 6, 7.

The front nip roller 6 may also have sprockets so it may be chained to sprockets of a receiver roller 8. This allows for a single motor to rotate both the nip rollers 6, 7 and the receiver roller 8.

FIG. 2 also illustrates a close up of the nip rollers 6, 7 and dams 20, 21. The resin would be added above the nip rollers 6, 7, in between the dams 20, 21. This would result in a resin pool above the nip rollers 6, 7 and held on the sides by the dams 20, 21. The dams 20, may be comprised of polycarbonate or various other materials as known to those skilled in the art. There may be two different resin pools above the nip rollers 6, 7. When the fabric is pushed through the nip rollers 6, 7, it creates a division between the front nip roller 6 and rear nip roller 7. This allows for a first resin pool to reside above the front nip roller 6, and in between the two dams 20, 21, and the fabric. The second resin pool resides above the rear nip roller 7, and in between the two dams 20, 21, and the fabric. Having two resin pools allows for impregnation of two different resins on either sides of the fabric. As the two resin pools are kept separated by the fabric, the distance between the dams 20, should be adjusted to accommodate the exact width of the fabric. Thusly, the gap between the dams 20, 21 and the fabric is minimized.

Figure 3B:
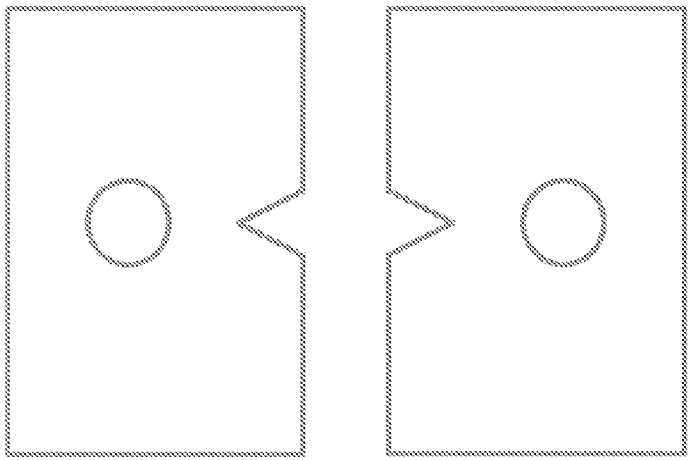
FIG. 3*b* is a top view of an embodiment of the dam.
Figure 3A:
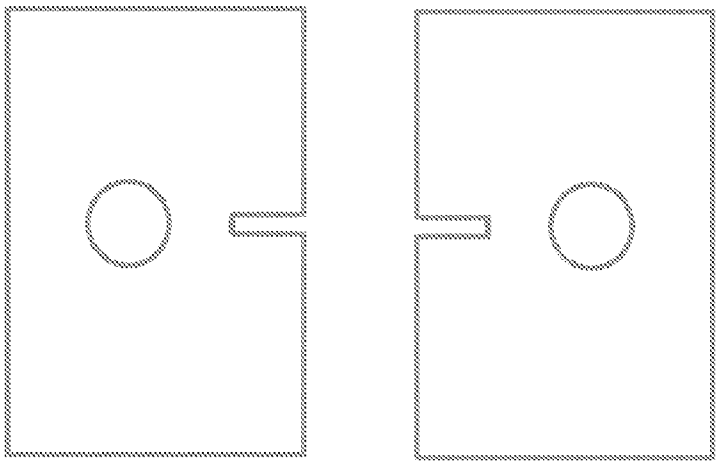
FIG. 3*a* is a top view of an embodiment of the dam.

In other embodiments, various shapes of dams may be used to create a better seal between the dams and the fiber. FIG. 3*a* shows once such embodiment of a shaped dam. FIG. 3*a* shows a top view of two complementary dams which have a recessed section for better guiding the fabric and better preventing the two resin pools from mixing. A possible disadvantage of this shape of dam is that the fabric may not experience a good level of impregnation at the side edges, as the side edges are not fully exposed to the resin pools. FIG. 3*b* is a top view of another embodiment of two complementary dams which have a more progressive recesses section, resolving some of the disadvantages of the dams of FIG. 3*a*.

Figure 4:
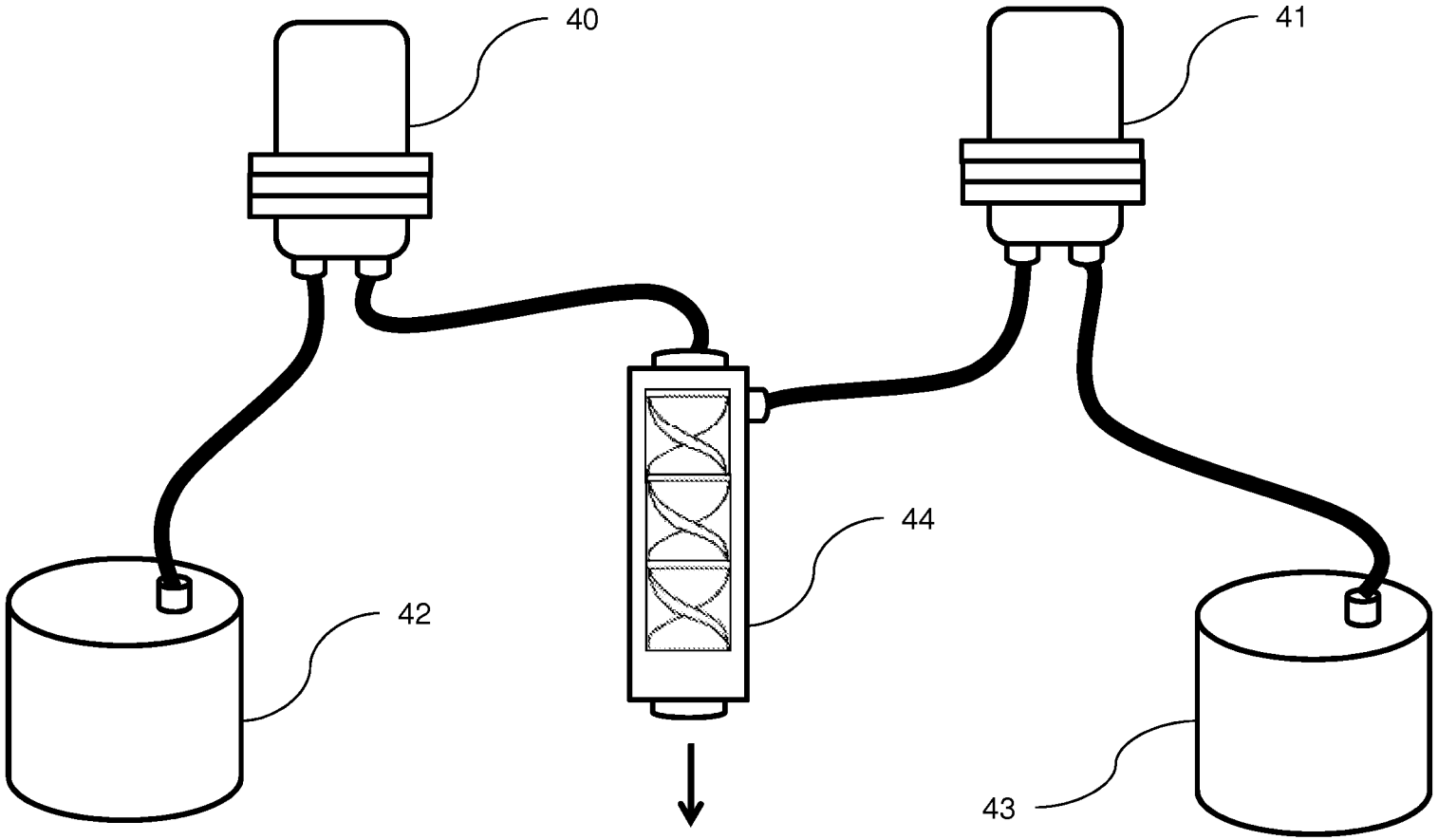
FIG. 4 is an illustration of an embodiment for the resin release mechanism.

FIG. 4 illustrates an embodiment of the resin release mechanism for catalyzed resin. The resin and catalyst sit in two separate reservoirs 42, 43. These reservoirs 42, 43 may be held by the apparatus or may simply sit on the ground. A positive displacement means, such as a positive displacement pump 40 may be utilized to move the resin from the resin reservoir 42 to a mixer 44, such as a static mixer. The catalyst may also be moved from the catalyst reservoir 43 to the mixer 44 using a positive displacement means, such as a positive displacement pump 41. The amount of resin and catalyst pumped into the mixer 44 should be adjustable to accommodate the proper ratio required to produce the desired catalyzed resin. For example, a common orthophthallic resin may be mixed with a catalyst such as methyl ethyl ketone. Once mixed, the catalyzed resin may be released into the resin pool.

Though not required, the release preferably occurs by fanning the catalyzed resin into the resin pool for more controlled release. This may be performed by taking the catalyzed resin, outputted from the mixer 44, and releasing it into the resin pool using a spray head capable of fanning. Two separate resin release mechanism may be utilized if there are two separate resin pools on either side of the fabric. If the resin is not a catalyzed resin, then a mixer may not be required, and the resin can be pumped from the reservoir and released into the resin pool(s). The rate of release can be controlled by manually adjusting the rate of positive displacement. The rate of release may also be automatically associated with the rate the fabric is being pushed out of the nip rollers 6, 7 (operational speed). During operation, it is desirable for the resin pools to be replenished at the same rate the resin is being depleted. Thusly, the faster the operational speed, the higher the desired rate of release. And conversely, the slower the operational speed, the lower the desired rate of release.

It may be desirable to use a dormant catalyzed resin. A dormant catalyzed resin is a resin mixed with a catalyst, where the catalyzed resin is not activated until triggered by some activation means, such as heat. In such a scenario, a post-impregnation dormant catalyst activator may be utilized. The post-impregnation dormant catalyst activator can be utilized on either side of the fabric, and is placed in a location where it can act on the fabric after impregnation (i.e., after the fabric has passed through the nip rollers 6, 7). If the activation required is heat, the post-impregnation dormant catalyst activator may be infrared radiation for heating. Other methods of activating a dormant catalyzed resin include light, chemicals, and mechanical force. The activation intensity post-impregnation dormant catalyst activator may be controlled manually or controlled automatically by having a control correlate the activation intensity with the operational speed. This correlation is usually a positive correlation. For example, assuming the activation means is heat, the higher the operational speed, the stronger the desired heat produced by the post-impregnation dormant catalyst activator. In another example, assuming the activation means is light, the higher the operational speed, the stronger the desired light produced by the post-impregnation dormant catalyst activator.

Referring to FIG. 1, a desirable location for a post-impregnation dormant catalyst activator is to attach it to the frame, in between the nip rollers 6, 7, and the receiver roller 8. There may be a first post-impregnation dormant catalyst activator for the one side of the fabric, and second post-impregnation dormant activator for the other side of the fabric. These two post-impregnation dormant catalyst activator may have differing forms of activation. E.g., the first may be focused heating, and the other may be chemical spraying.

Although only referred embodiments has been described herein, many modifications will become readily apparent to one skilled in the art.

What is claimed is:

1. An apparatus comprising:

a first nip roller;

a second nip roller opposing said first nip roller and said second nip roller rotating in the opposite direction of said first nip roller, wherein said first nip roller further comprises of a first main sprocket wheel and said second nip roller further comprises of a second main sprocket wheel, such that said first main sprocket wheel engages with said second main sprocket wheel to rotate said second nip roller in the opposite rotational direction of said first nip roller when said first nip roller rotates and wherein said first nip roller further comprises of a drive sprocket wheel engaging with a first roller chain to rotate said drive sprocket wheel, thereby rotating said first nip roller;

a dam holder bar, above said first nip roller and said second nip roller;

a first dam, attached to said dam holder bar, said first dam placed flush above said first nip roller and said second nip roller;

a second dam, attached to said dam holder bar, said second dam placed flush above said first nip roller and said second nip roller, wherein each of said first and second dam are attached to said dam holder bar via an attachment rod, and wherein said attachment rod allows for linear, up and down movement of each of said dam and generates downward force on each of said dam;

a resin pool held by said first nip roller, said second nip roller, said first dam and said second dam;

a resin release mechanism for releasing resin into said resin pool; and a receiver roller with a receiver roller sprocket wheel, and said first nip roller further comprises of an auxiliary sprocket wheel, wherein a second roller chain engages with said auxiliary sprocket wheel and said receiver roller sprocket wheel such that said receiver roller rotates at the same operational speed as said first nip roller.

2. The apparatus of claim 1, further comprising of a roll dispensing bar located above said first and second nip rollers.

3. The apparatus of claim 1 wherein said resin release mechanism is further comprised of:

a resin reservoir containing resin;

a catalyst reservoir containing catalyst;

a mixer;

a first pump for pumping said resin from said resin reservoir to said mixer; and a second pump for pumping said catalyst from said catalyst reservoir to said mixer, said mixer producing catalyzed resin from said resin and said catalyst, and said catalyzed resin releasing into said resin pool.

4. An apparatus comprising:

a first nip roller;

a second nip roller opposing said first nip roller and said second nip roller rotating in the opposite direction of said first nip roller;

a first dam flush above said first nip roller and said second nip roller;

a second dam flush above said first nip roller and said second nip roller;

a fiber sheet, with a first side and a second side, passing between said first nip roller and said second nip roller, wherein said first dam and said second dam have a recessed section for enclosing a side edge portion of said fiber sheet;

a first resin pool held by said first nip roller, said second nip roller, said first dam, said second dam, and said first side of said fiber sheet; and a second resin pool held by said first nip roller, said second nip roller, said first dam, said second dam, and said second side of said fiber sheet.

5. The apparatus of claim 4, further comprising a dam holder bar, above said first nip roller and said second nip roller, wherein each of said first dam and second dam are attached to said dam holder bar.

6. The apparatus of claim 5, wherein each of said first dam and said second dam are attached to said dam holder bar via an attachment rod, and wherein said attachment rod allows for linear, up and down movement of each of said dam.

7. The apparatus of claim 6, wherein said attachment rod generates a pressurized downward force on each of said dam.

8. The apparatus of claim 7, wherein said first nip roller further comprises of a first main sprocket wheel and said second nip roller further comprises of a second main sprocket wheel, such that said first main sprocket wheel engages with said second main sprocket wheel to rotate said second nip roller in the opposite rotational direction of said first nip roller when said first nip roller rotates.

9. The apparatus of claim 8, wherein said first nip roller further comprises of a drive sprocket wheel engaging with a first roller chain to rotate said drive sprocket wheel, thereby rotating said first nip roller.

10. The apparatus of claim 9, further comprising of a roll dispensing bar located above said first and second nip rollers.

11. The apparatus of claim 10, further comprising of a receiver roller with a receiver roller sprocket wheel, and said first nip roller further comprises of an auxiliary sprocket wheel, wherein a second roller chain engages with said auxiliary sprocket wheel and said receiver roller sprocket wheel such that said receiver roller rotates at the same operational speed as said first nip roller.

* * * * *